United States Patent [19]

Persson

[11] Patent Number: 4,573,335

[45] Date of Patent: Mar. 4, 1986

[54] HYDRAULIC PRESS WITH PRESSURE CELL

[75] Inventor: Hans Persson, Helsingborg, Sweden

[73] Assignee: ASEA Aktiebolag, Västeras, Sweden

[21] Appl. No.: 692,716

[22] Filed: Jan. 18, 1985

[30] Foreign Application Priority Data

Jan. 20, 1984 [SE] Sweden ..... 8400271

[51] Int. Cl.[4] ..... B21D 22/12

[52] U.S. Cl. ..... 72/63

[58] Field of Search ..... 72/60, 63; 29/421 R; 425/389, 394, 405

[56] References Cited

U.S. PATENT DOCUMENTS

| | | | |
|---|---|---|---|
| 3,007,427 | 11/1961 | Bryan et al. | 72/63 |
| 3,021,803 | 2/1962 | Lacey, Jr. | 72/63 |
| 3,033,143 | 5/1962 | Grankowski | 72/63 |
| 3,531,966 | 10/1970 | Pappas | 72/63 |
| 3,545,241 | 12/1970 | Grankowski | 72/63 |
| 3,875,778 | 4/1975 | Hellgren | 72/63 |
| 3,938,361 | 2/1976 | Claesson | 72/63 |
| 4,079,613 | 3/1978 | Syvakari | 72/63 |
| 4,080,139 | 3/1978 | Hellgren | 72/63 |
| 4,112,724 | 9/1978 | Claesson | 72/63 |
| 4,365,494 | 12/1982 | Kurovich | 72/63 |

*Primary Examiner*—Leon Gilden

*Attorney, Agent, or Firm*—Watson, Cole, Grindle & Watson

[57] ABSTRACT

A hydraulic press with a pressure cell comprises a tray-shaped press plate with a bag-like diaphragm and a forming rubber pad and a press tray for a forming tool and a workpiece. The end wall portions projecting from the mid portions of each of the press plate and from the base of the press tray, provide thickness transitions which define a cavity in the operating position of the press tray. Between the press plate and/or the base of the press tray and the confronting force-absorbing surfaces of the yokes of the press frame of the press, play is provided in a portion above and below, respectively, the thickness transitions. This play allows the high stress levels which would otherwise arise at the thickness transitions to be reduced.

4 Claims, 5 Drawing Figures

8

HYDRAULIC PRESS WITH PRESSURE CELL

BACKGROUND OF THE INVENTION

The present invention relates to a press with a very large working surface with a pressure cell which applies pressure to a resilient forming pad, the pressure cell, via the forming pad, pressing sheet-formed workpieces over a forming tool or form block in a working space below the forming pad to shape the workpieces in a required way. The pressure cell and the forming pad are arranged in a cavity in a tray-shaped press plate which is attached to an upper force-absorbing member in a press stand or frame. The form block is disposed in the cavity in a tray-shaped displaceable supporting member (hereafter referred to as the press tray) which, after insertion into the working space, together with the press plate and elements cooperating therewith in the press frame forms a closed volume. A pressure medium (e.g. oil) is then pumped into the pressure cell to expand the same and force the forming pad downwards against a workpiece to be formed.

During the pressing operation, the forming pad will influence the end wall portions of the press plate and the base of the press tray in an axially upward direction. Owing to the high working pressure used in modern presses—100 Mpa and thereabove—these forces will be very great and because of the stress intensification which arises at a transition zone between thicker and thinner regions of a plate subjected to heavy stress, the edge/end regions of the press plate and the base of the press tray will experience very high stresses which lower the fatigue life of those components.

Presses of the kind to which the invention relates are described, inter alia in the specifications of U.S. Pat. Nos. 3,875,778 (Hellgren), 3,938,361 (Claesson et al) and 3,949,583 (Syvakari) all of which have been assigned to the assignee of this application.

OBJECTS OF THE INVENTION

One object of the invention is to improve the design of a hydraulic press with a pressure cell so as to achieve reduced stress levels in the press plate and/or in the base of the press tray. A further object is to increase the fatigue life of these components by reducing stress levels occurring at zones of thickness transition in the press plate and press tray base.

SUMMARY OF THE INVENTION

According to the invention, a reduction of the high stress at a thickness transition zone (e.g. between the intermediate portion and an end wall portion) is achieved in either or both of the press plate or base of the press tray by the provision of play between the press plate and/or between the base of the press tray and the confronting force-absorbing surface in the press frame, in the vicinity of the thickness transition zone. This play results in a deformation within the non-supported portion of the press plate and/or of the base of the press tray, respectively, of such a kind that a superimposed compressive stress arises in the sensitive zone where the thickness transition occurs. This results in a reduction of the tensile stress caused by the axially outwardly-directed forces from the press pad on the end wall portions of the press plate and/or base of the press tray.

The above-mentioned play may be provided in many different ways. For example, a transverse recess may be provided on the outwardly facing side of the press plate and/or base of the press tray confronting the respective force-absorbing surface, or a spacing plate may be inserted between the press plate or the base of the press tray and the respective force-absorbing surface. It is also possible to provide a recess in the force-absorbing surface.

BRIEF DESCRIPTION OF THE DRAWINGS

The invention will be described in greater detail, by way of example, with reference to the accompanying drawings, wherein.

DESCRIPTION OF PREFERRED EMBODIMENT

Figure 1:
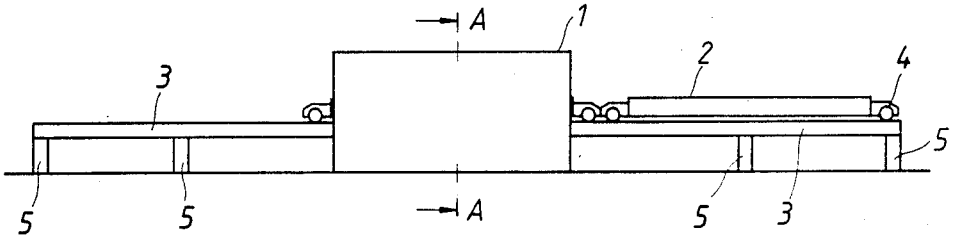
FIG. 1 shows, purely schematically, a side view of a press plant.

In the FIGS., 1 designates a press frame and 2 a press tray in which a form block tool and a blank to be shaped are placed. The press tray 2 is provided with transport wheels 4 running on rails 3 elevated on columns 5, and is displaceable between a position fully outside the press frame 1, where pressed parts are removed and a new blank is positioned on the form block tool, and a position inside the press frame where the pressing operation is carried out.

Figure 2:
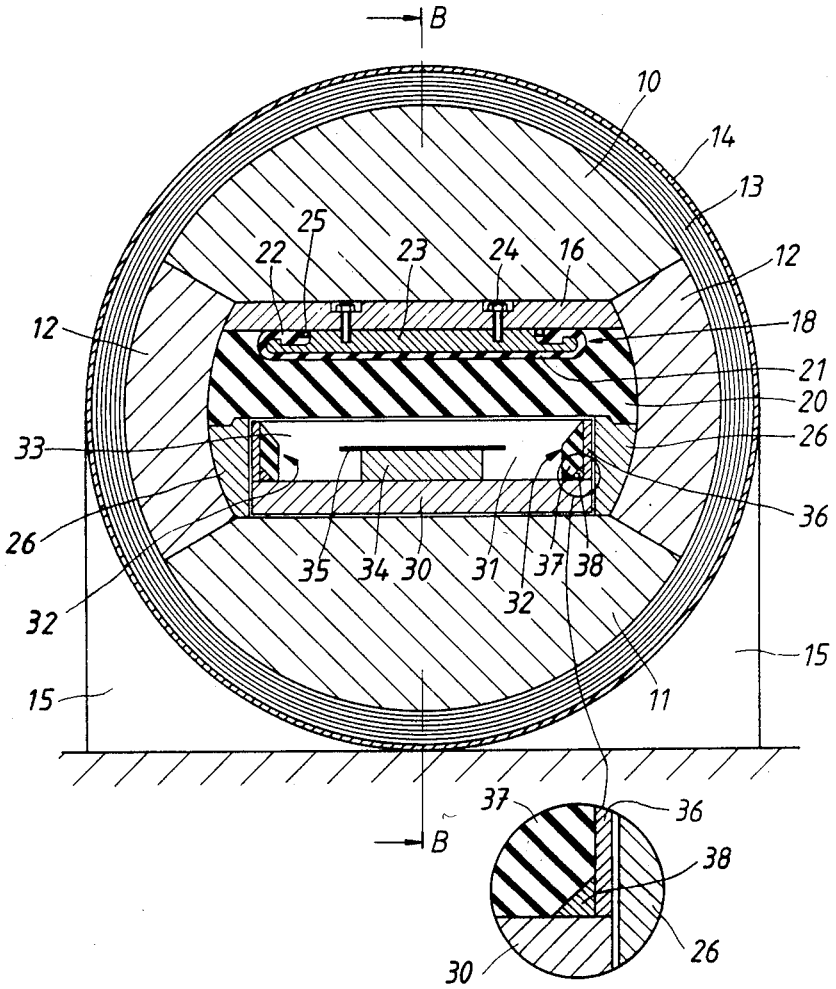
FIG. 2 shows an enlarged cross-section of the press frame of the press plant taken on the line A—A in FIG. 1.
Figure 3:
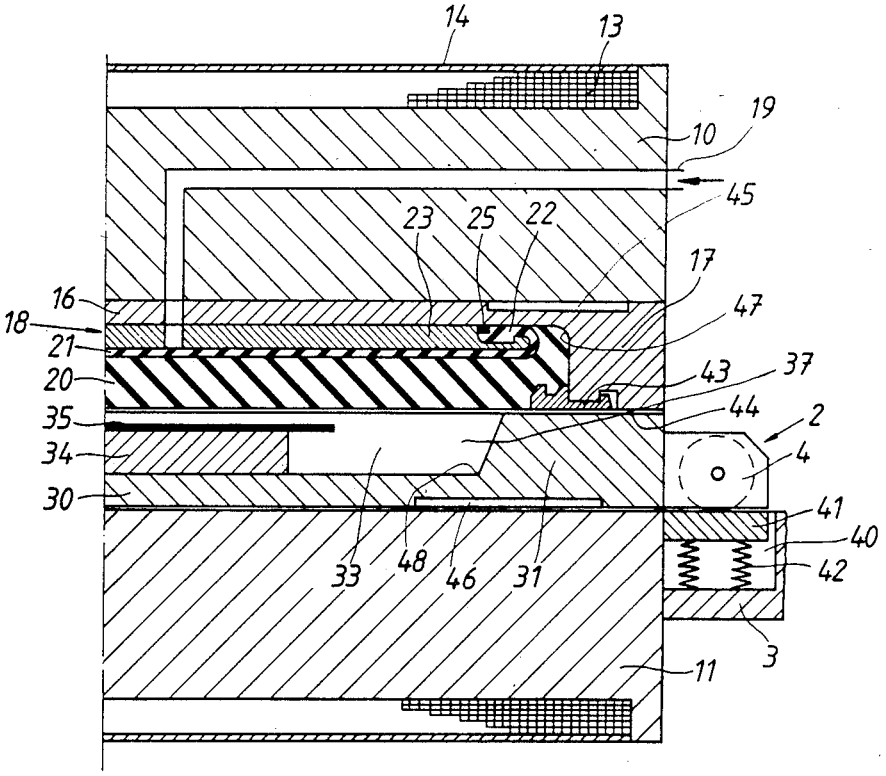
FIG. 3 shows a longitudinal section of an end portion of the press frame taken on the line B—B in FIG. 2, and FIGS. 4 and 5 show scrap sections of the press illustrating possible modified constructions.

The press frame 1 in FIGS. 2 and 3 is of the type which is built up of an upper yoke 10, a lower yoke 11, and a pair of spacers 12, a prestressed strip sheath 13 and a protective sheet cover 14 around the strip sheath. The press frame 1 rests on carrying supports 15 with supporting surfaces adapted to the shape of the cover 14. The yokes 10 and 11 and the spacers 12 form a space with a substantially rectangular cross-section. In the upper part of this space, there is a press plate 16 with end wall pieces 17. In the volume between these end wall pieces 17 and the spacers 12 in the press frame, a pressure cell 18 and a rubber-elastic press pad 20 are located. The pressure cell 18 is formed from a bag-like diaphragm 21 having a continuous bead 22 surrounding the opening in the diaphragm and a plate 23 with a continuous slot adapted to receive said bead 22. This plate 23 is attached to the press plate 16 by bolts 24 so that the upper surface of the bead 22 is pressed against the undersurface of the plate 16. Between the bead 22 and the press plate 16 a slot is provided for a sealing ring 25. The pressure cell 18 is supplied with pressure medium through a conduit 19. Along the sides of the volume in the press frame are located side rails 26 supporting the long sides of the press pad 20.

The press tray 2 is constructed from a base plate 30 with protruding end wall portions 31 and loose side strips 32. Between the end wall portions 31 and the strips 32 there is formed a cavity 33, in which a form block 34 is positioned. Contrary to prior art presses, where the side strips have consisted of a solid steel rail, the side strips 32 in the illustrated embodiment consist of a sheet 36 and a fill-up strip 37 of elastic material such as rubber or plastics, and an anti-extrusion strip 38 preventing the material in the fill-up strip 37 from being extruded between the base 30 and the sheet 36. At the end portions of the press frame 1, the rails 3 have a recess 40 with a plate 41 which is supported by springs 42 on such a strength that they are able to support the press tray 2 when it is rolled into and out of the press frame 1, but permit the press tray 2—during a pressing operation—to be pressed down against the lower yoke 11 without significant resistance. At the end portions of the press frame, the end wall portions 17 of the press plate 16 are provided with anti-extrusion strips 43, which are intended to prevent the pad 20 from being extruded through the gap 44 between the end wall portion 31 of the press tray 2 and the end wall portion 17.

The upper surface of the press plate 16 is provided with a transverse recess 45, which suitably extends across the entire width of the press plate 16. The lower surface of the base 30 of the press tray 2 is provided with a corresponding recess 46. Above and below the recessed portions, respectively, there is thus formed a clearance between the press plate 16 and the force-absorbing lower surface of the upper yoke 10, and between the base 30 of the press tray and the force-absorbing upper surface of the lower yoke 11, respectively, in a portion above and below, respectively, the transition (47, 48) between the thin portion and the thicker end wall portions (17, 31).

The clearance provided between the press plate 16 and the basse 30 and the confronting surface of the respective force-absorbing yoke by the recesses 45, 46, should have such a size that neither disappears completely at the highest working pressure of the press.

Figure 4:
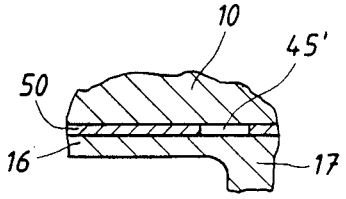
Figure 5:
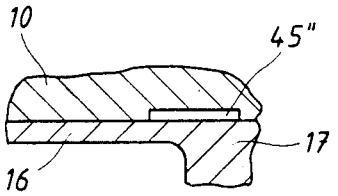

To relieve the high stresses at the thickness transitions of the press plate 16 and the base 30 of the press tray 2, some play is required and in FIG. 3 this is provided by forming recesses in the faces of the members 16, 30 confronting the yokes 10 and 11. However the required play can be provided in other ways, and FIG. 4 shows a scrap section of the transition region of the press plate 16 where a recess 45' has been created by inserting a spacing plate 50 between the press plate 16 and the yoke 10 in the central and outer regions of the latter. FIG. 5 shows the play in this region created by forming a recess 45" in the yoke 10. It will be appreciated that arrangements similar to those shown in FIGS. 4 and 5 are possible between the base 30 and the yoke 11.

In a large press with a working volume of about 1×3 m and a height between the force-absorbing surfaces of the yokes 10 and 11 of about 650 mm, the mid-portion of the press plate 16, for example, may have a thickness of about 150 mm and the end wall portion 17 a thickness of about 250 mm. In a press of this kind, the recess 45 should have a depth larger than about 0.3 mm in order to obtain the best effect. The width of the recess 45 should be of the order of magnitude of 200–300 mm. Similar dimensions would apply to the recess 46 or 45', 45".

Various modifications are clearly possible to the arrangements shown in FIGS. 2 and 3 and all such modifications falling within the scope of the invention are intended to be part of this invention.

What is claimed is:

1. A press of pressure cell type which includes:

a press frame having opposed force-absorbing members defining a cavity therebetween, a press tray movable into the said cavity and having a base on which a form block having a forming surface and a workpiece to be shaped to the forming surface are located, a press plate supporting an expansible pressure cell within the said cavity, means to expand the pressure cell when a press tray is within the cavity to force the workpiece against the said forming surface, the press plate and the base of the press tray, each having at least one zone of thickness transition, wherein play is provided between at least one of the said press plate and the said base of the press tray and its confronting force-absorbing member in the vicinity of a said zone of thickness transition.

2. A press according to claim 1, in which at least one of the press plate and the base of the press tray is formed with a transverse recess in the side facing the respective pressure-absorbing member in the vicinity of the zone of thickness transition.

3. A press according to claim 1, in which between at least one of the press plate and the base of the press tray and the respective force-absorbing member in a region remote from the said zone of thickness transition, at least one spacing plate is located to leave a gap which provides the said play in the vicinity of the said zone.

4. A sheet press according to claim 1, in which at least one of the surfaces of the force-absorbing members of the press frame confronting the cavity is formed with a transverse recess providing said play.

* * * * *